US009958227B2

(12) United States Patent
Whitson

(10) Patent No.: US 9,958,227 B2
(45) Date of Patent: May 1, 2018

(54) SUPPRESSOR MOUNTING DEVICE

(71) Applicant: Jon David Whitson, Plano, TX (US)

(72) Inventor: Jon David Whitson, Plano, TX (US)

( * ) Notice: Subject to any disclaimer, the term of this patent is extended or adjusted under 35 U.S.C. 154(b) by 0 days. days.

(21) Appl. No.: 15/405,217

(22) Filed: Jan. 12, 2017

(65) Prior Publication Data

US 2017/0205176 A1 Jul. 20, 2017

Related U.S. Application Data

(60) Provisional application No. 62/280,719, filed on Jan. 20, 2016.

(51) Int. Cl.

*F41A 21/32* (2006.01)
*F41A 21/30* (2006.01)
*F41A 21/36* (2006.01)

(52) U.S. Cl.

CPC ..... *F41A 21/325* (2013.01); *F41A 21/30* (2013.01); *F41A 21/36* (2013.01)

(58) Field of Classification Search

CPC ..... F41A 21/325
USPC ..... 89/14.4
See application file for complete search history.

(56) References Cited

U.S. PATENT DOCUMENTS 5,559,302 A * 9/1996 Latka ..... F41A 21/325 89/14.05
7,661,349 B1 2/2010 Brittingham
7,743,693 B1 6/2010 Brittingham
7,789,009 B1 9/2010 Brittingham
7,891,282 B1 2/2011 DeGroat
7,891,284 B1 2/2011 Barrett
8,387,299 B1 * 3/2013 Brittingham ..... F41A 21/30 42/90
8,555,765 B2 * 10/2013 Graham, II ..... F41A 21/325 285/92
2016/0010936 A1 4/2016 Moon

OTHER PUBLICATIONS

Advanced Armament Corporation, "Muzzle Brakes," http://www.advanced-armament.com/Muzzle-Brakes_c_32.html, (c) 2016, Accessed Dec. 22, 2016.

(Continued)

*Primary Examiner* — Stephen Johnson
(74) *Attorney, Agent, or Firm* — Bennet K. Langlotz; Langlotz Patent & Trademark Works, Inc.

(57) ABSTRACT

A firearm suppressor mounting device has a body defining a body bullet passage on a bore axis and having a first attachment facility at a first end, the first attachment facility adapted to connect to the muzzle of the firearm, the body having a second attachment facility, a device adapted to removably and rotatably connect to the second attachment facility, a retention facility connected to the body and movable between an engaged position in which the retention facility abuts the device and a disengaged position in which the retention facility is spaced apart from the device, and each of the retention facility and the device having a plurality of engagement features that are engaged to each other to prevent rotation of the device with respect to the body when the retention facility is in the engaged position. The retention facility may encircle the bore axis.

20 Claims, 8 Drawing Sheets

(56) References Cited

OTHER PUBLICATIONS

Advanced Armament Corporation, "SR7(tm) Fast-Attach 7.62 Silencer," http://www.advanced-armament.com/SR7_p_442.html, (c) 2016, Accessed Dec. 22, 2016.
Advanced Armament Corporation, MG-SD(tm) Fast-Attach 30cal Silencer, http://www.advanced-armament.com/MG-SD_p_445.html, (c) 2016, Accessed Dec. 22, 2016.

* cited by examiner

SUPPRESSOR MOUNTING DEVICE

REFERENCE TO RELATED APPLICATION

This application claims priority to U.S. Provisional Application Ser. No. 62/280,719 filed Jan. 20, 2016, and entitled, "SOUND MODERATOR MOUNTING DEVICE."

FIELD OF THE INVENTION

The present invention relates to firearms, and more particularly to facilities for mounting a device on the muzzle, such as a sound suppressor.

BACKGROUND OF THE INVENTION

It is often desirable to mount removable devices at the muzzle of a firearm, such as a suppressor. A suppressor is a device attached to the barrel of a firearm that reduces the amount of noise and also usually the amount of muzzle flash generated by firing the weapon. A suppressor is usually a metal cylinder with internal mechanisms such as baffles to reduce the sound of firing by slowing the escaping propellant gas and sometimes by reducing the velocity of the bullet. The suppressor is typically a hollow cylindrical piece of machined metal (steel, aluminum, or titanium) containing expansion chambers that attaches to the muzzle of a pistol, submachine gun or rifle. These "can"-type suppressors may be attached to and detached from various firearms.

A conventional muzzle mounted accessory, such as a suppressor, may be internally threaded to engage a threaded end of a firearm barrel. This has the disadvantage of being slow to mount and dismount, which is a serious concern in military and law enforcement contexts. Friction-type attachments that rely solely on threads also can loosen because there is no mechanical lock; only friction prevents the attachment from unscrewing from the firearm. A loose suppressor can result in bullet strikes on the baffles because the baffles are not axially registered with the bore of the barrel. Barrel strikes cause inaccuracy, present safety problems, and decrease equipment durability.

The use of coarser threads can improve the mounting and dismounting speed, but coarser threads are even more prone to loosening caused by the mechanical impulse of firing, as well as thermal stresses and changes during use.

Other prior art suppressor mounts provide quicker disconnection, but suffer other disadvantages such as inadequate repeatable precision of alignment (which generates shooting inaccuracy), complexity and cost of manufacture, and durability. For example, fine tooth ratchet systems tend to wear out rapidly and can loosen during use. The small locking teeth can fill with debris or become worn to the point they no longer work. Also, the ratchet teeth cannot always perfectly align and must be backed off to enable locking, which makes the attachment loose on the firearm. In addition, an approach including a pivotable pawl with 2 or 3 teeth on the suppressor, and a toothed ring on a muzzle device prevents unintended loosening, except that the pawl is vulnerable to significant wear and failure, resulting in serious suppressor baffle strikes. The wear occurs because the pawl always engages the same teeth on the toothed ring, resulting in asymmetrical wear of those teeth.

Therefore, a need exists for a new and improved firearm suppressor mounting device that resists wear and ensures a suppressor will not loosen during normal operation of the firearm. In this regard, the various embodiments of the present invention substantially fulfill at least some of these needs. In this respect, the firearm suppressor mounting device according to the present invention substantially departs from the conventional concepts and designs of the prior art, and in doing so provides an apparatus primarily developed for the purpose of resisting wear and ensuring a suppressor will not loosen during normal operation of the firearm.

SUMMARY OF THE INVENTION

The present invention provides an improved firearm suppressor mounting device, and overcomes the above-mentioned disadvantages and drawbacks of the prior art. As such, the general purpose of the present invention, which will be described subsequently in greater detail, is to provide an improved firearm suppressor mounting device that has all the advantages of the prior art mentioned above.

To attain this, the preferred embodiment of the present invention essentially comprises a body defining a body bullet passage on a bore axis and having a first attachment facility at a first end, the first attachment facility adapted to connect to the muzzle of the firearm, the body having a second attachment facility, a device adapted to removably and rotatably connect to the second attachment facility, a retention facility connected to the body and movable between an engaged position in which the retention facility abuts the device and a disengaged position in which the retention facility is spaced apart from the device, and each of the retention facility and the device having a plurality of engagement features that are engaged to each other to prevent rotation of the device with respect to the body when the retention facility is in the engaged position. The retention facility may encircle the bore axis. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
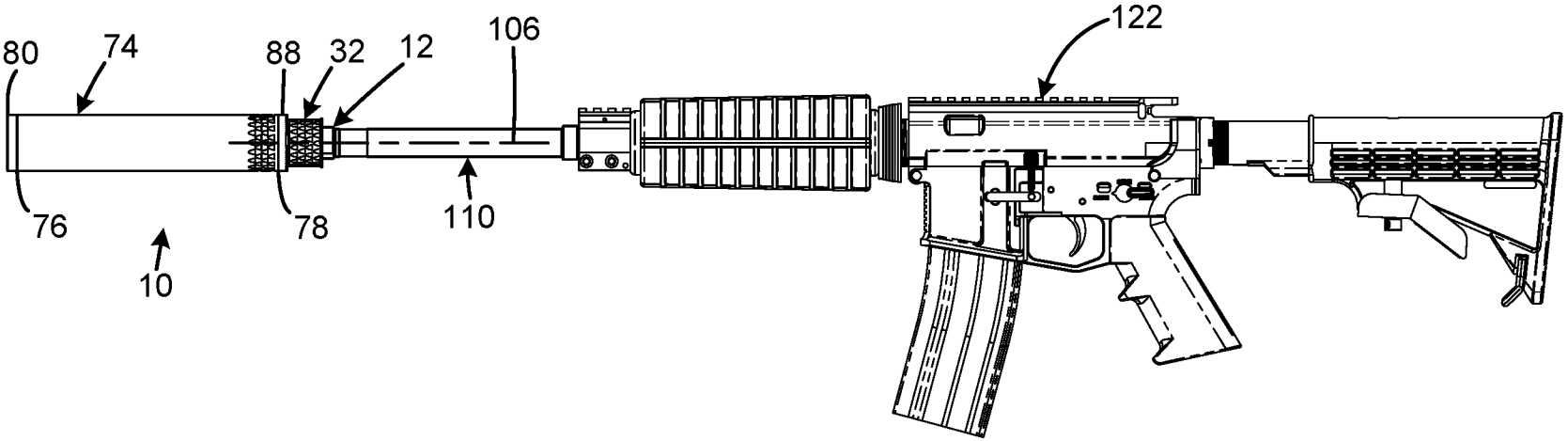
FIG. 1 is a left side view of the current embodiment of a firearm suppressor mounting device constructed in accordance with the principles of the present invention in use.
Figure 2:
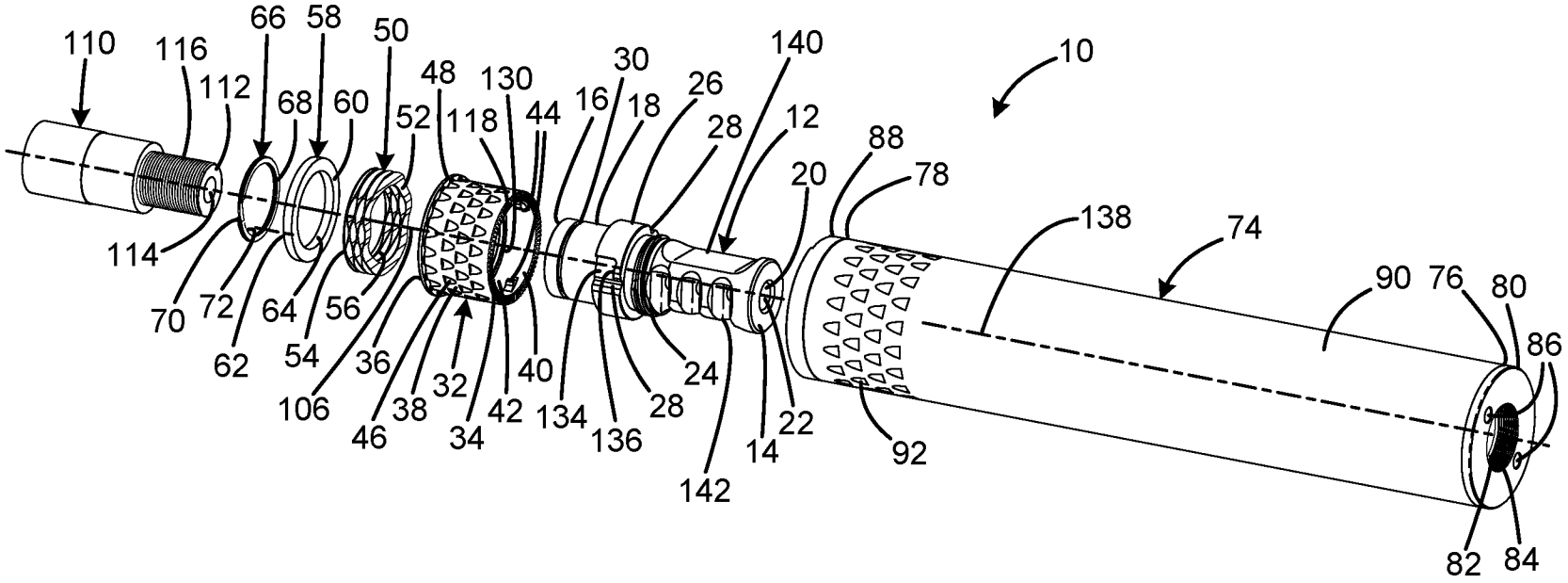
FIG. 2 is an exploded view of the firearm suppressor mounting device of the present invention.
Figure 3A:
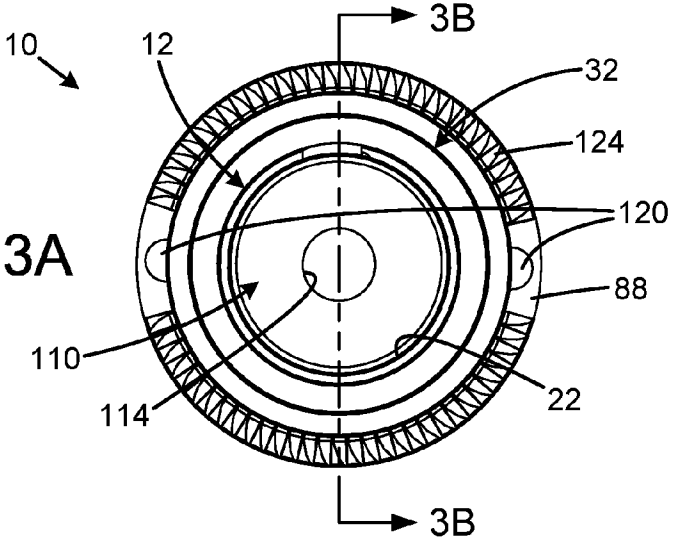
FIG. 3A is a rear view of the firearm suppressor mounting device of the present invention in the secured condition.
Figure 3B:
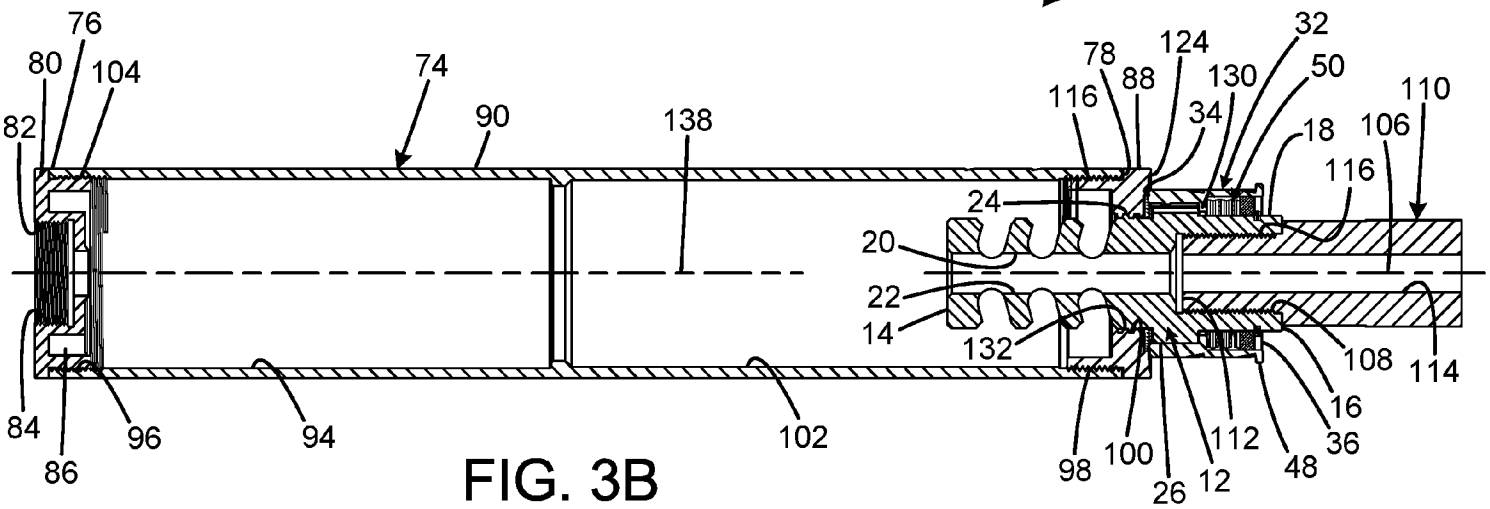
FIG. 3B is a side sectional view of the firearm suppressor mounting device taken along the line 3B-3B of FIG. 3A. in the secured condition.

An embodiment of the firearm suppressor mounting device of the present invention is shown and generally designated by the reference numeral 10.

FIGS. 1-4B illustrate the improved firearm suppressor mounting device 10 of the present invention. More particularly, in FIG. 1 the mounting device 10 is shown in use securely mounting a suppressor 74 to the barrel 110 of a firearm 122, and in FIGS. 2A-4B, the mounting device 10 is also shown in the secured condition. The barrel 110 has a muzzle 112, a central barrel bore 114, and an exterior threaded portion 116. The central barrel bore 114 defines a bore axis 106. The mounting device 10 includes a body/muzzle brake 12, a retention facility/slip ring 32, a wave spring 50, a dust washer 58, and a retaining ring 66. The device/suppressor 74 includes a front cap 80 and a rear cap 88.

The muzzle brake 12 has a front 14, rear 16, exterior 18, and interior 20. The interior 20 defines a body bullet passage/central bore 22 that is on/axially registered with the bore axis 106 when the muzzle brake is attached to the barrel 110. The muzzle brake 12 also defines a first attachment facility/rear portion 108 (shown in FIG. 3B) that screws on to the threaded portion 116 on the muzzle end of the barrel. The exterior of the muzzle brake 12 has a second attachment facility/threaded portion 24, a flange 26 located immediately behind the threaded portion that defines two longitudinal slots 28 with recess 134, and a groove 30 slightly forward of the rear.

The retention facility/slip ring 32 has a front 34, rear 36, exterior 38, and interior 40. The exterior defines a forward-facing saw tooth wave 118, and grip features 46 on a textured outer wall surface 38 and a rear raised edge 48 to facilitate manual gripping for rearward axial movement and rotation of the slip ring 32 by a user's hand. The interior 40 defines three interior splines 44 (one spline cannot be seen in this viewing angle) and a shoulder 130. Each of the saw teeth has a sloped cam surface and an opposing flat surface (best seen in FIG. 4B) that allows rotation of the suppressor 74 in the clockwise direction and prevents rotation of the suppressor 74 in the counter-clockwise direction (viewed from the front end of the suppressor) about the threaded portion 24 of the muzzle brake 12. In the current embodiment, the saw tooth wave 118 has 75 saw teeth, and the splines 44 are sized to be closely received within the longitudinal slots 28 in the flange 26 of the muzzle brake 12. Each longitudinal slot has an adjacent recess 134, which will be explained later. The slip ring 32 encircles the bore axis 106 and is movable both axially in a direction parallel to the bore axis and circumferentially around the bore axis 106 inside the cavity 134 between an engaged position and a disengaged position.

Figure 4B:
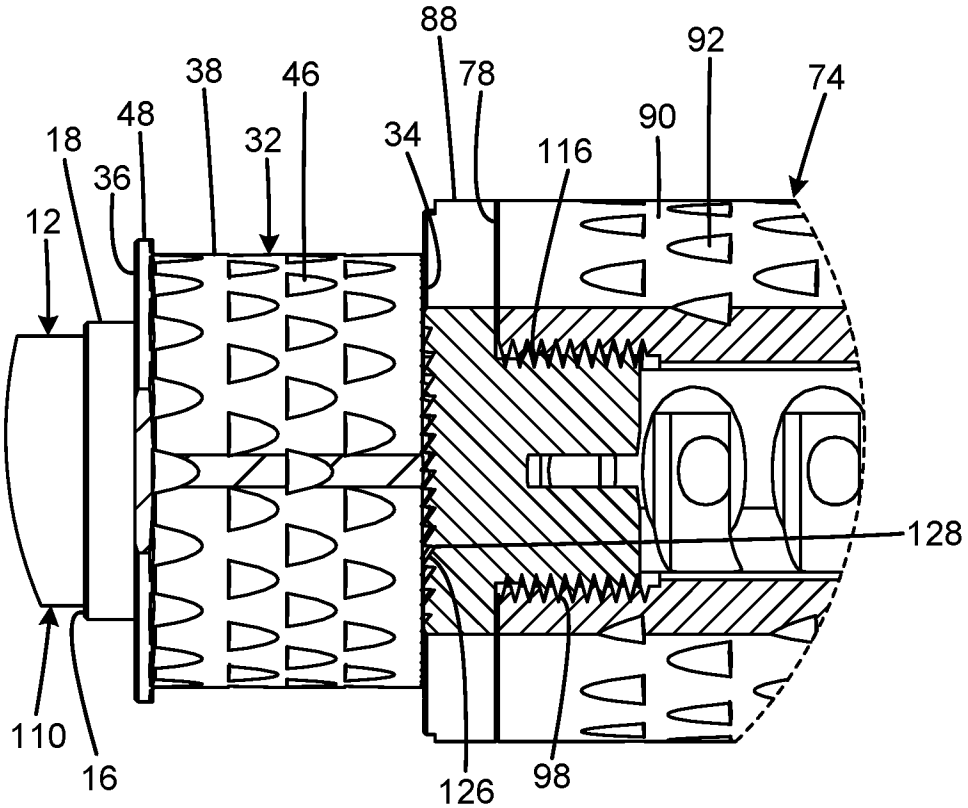
FIG. 4B is a side sectional view of the firearm suppressor mounting device taken along the line 4B-4B of FIG. 4A. in the secured condition.
Figure 4A:
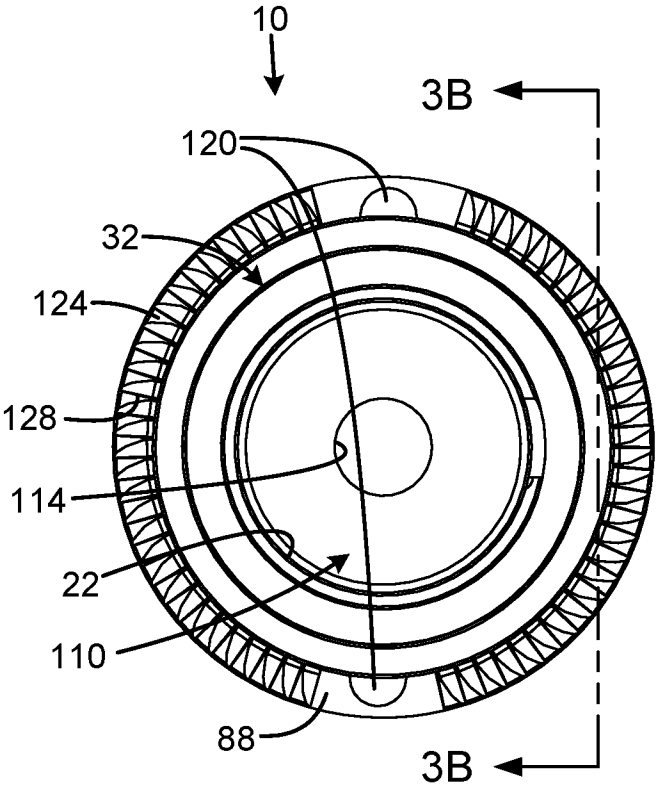
FIG. 4A is a rear view of the firearm suppressor mounting device in the secured condition.
Figure 5A:
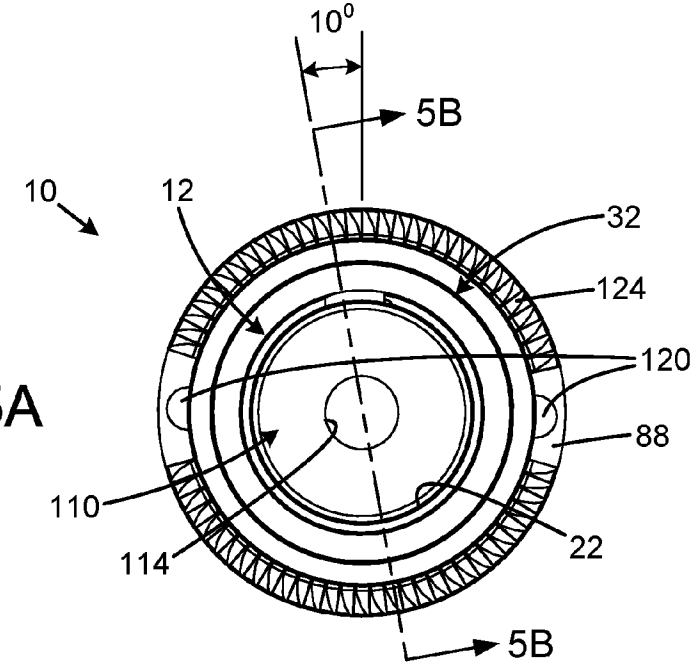
FIG. 5A is a rear view of the firearm suppressor mounting device of the present invention in the unsecured condition.
Figure 5B:
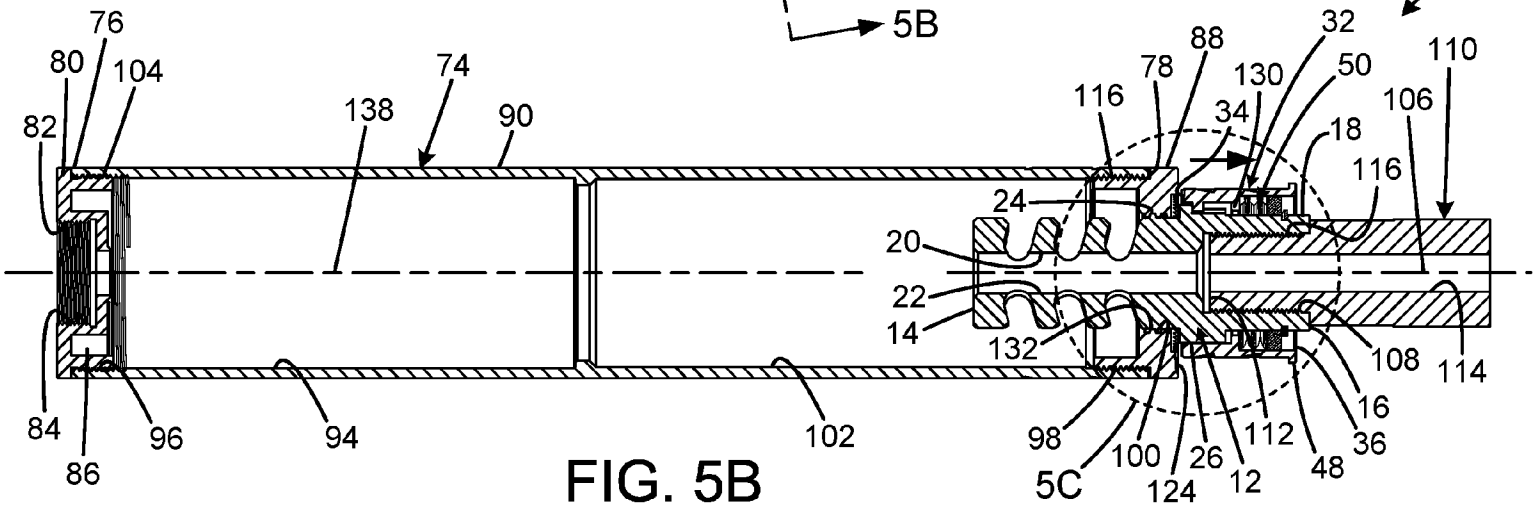
FIG. 5B is a side sectional view of the firearm suppressor mounting device taken along the line 5B-5B of FIG. 5A. in the unsecured condition.
Figure 5C:
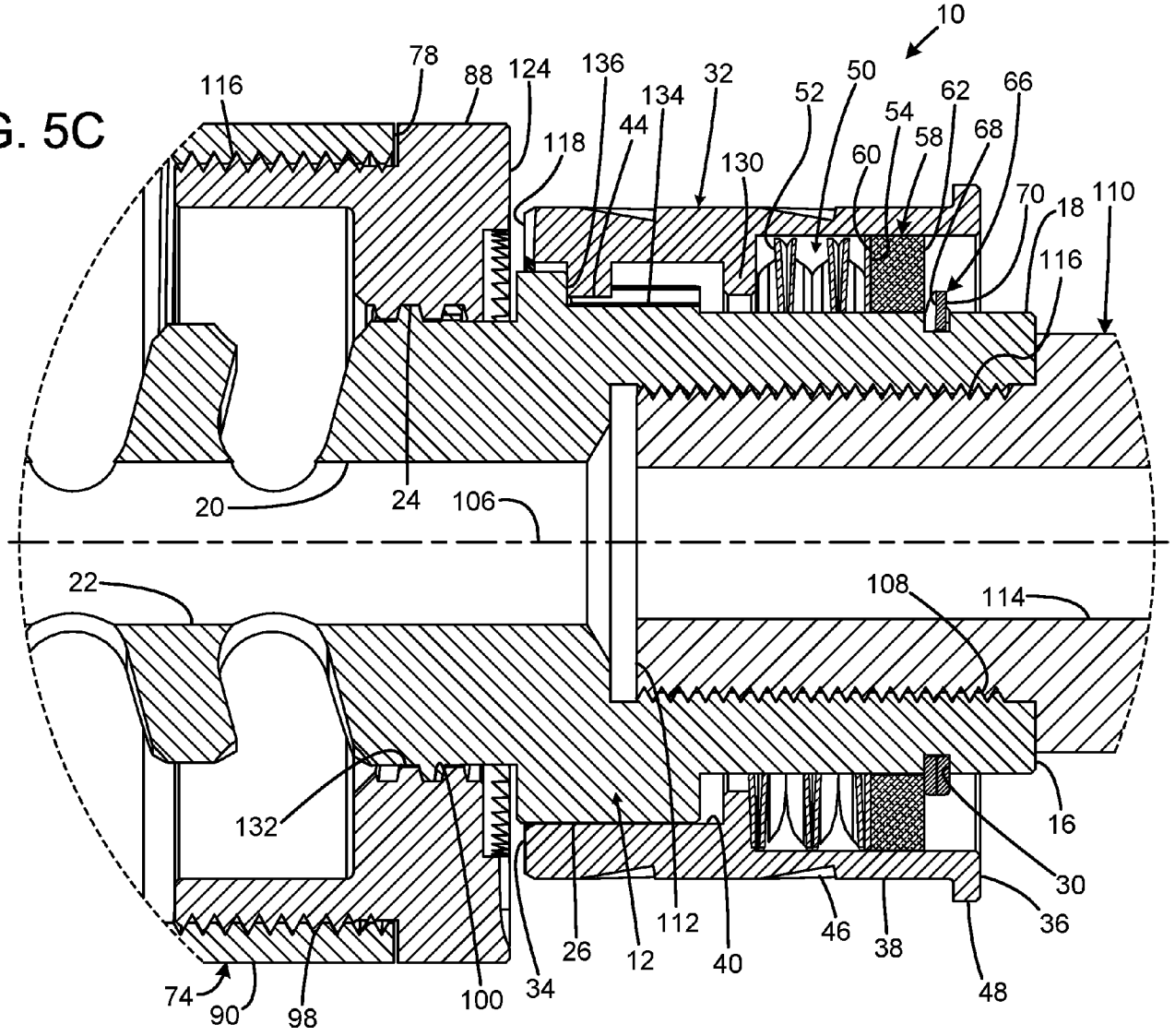
FIG. 5C is an enlarged view of the firearm suppressor mounting device taken along circle 5C of FIG. 5B in the unsecured condition.
Figure 6A:
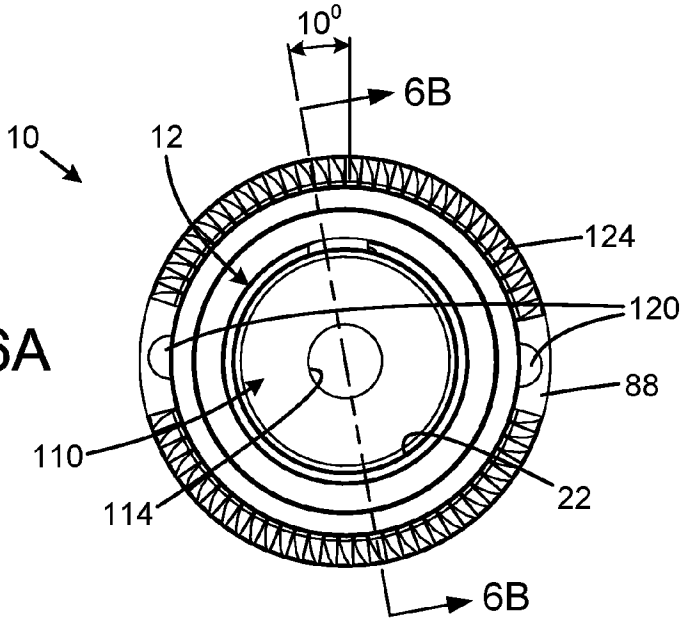
FIG. 6A is a rear view of the firearm suppressor mounting device of the present invention in the unsecured condition.
Figure 6B:
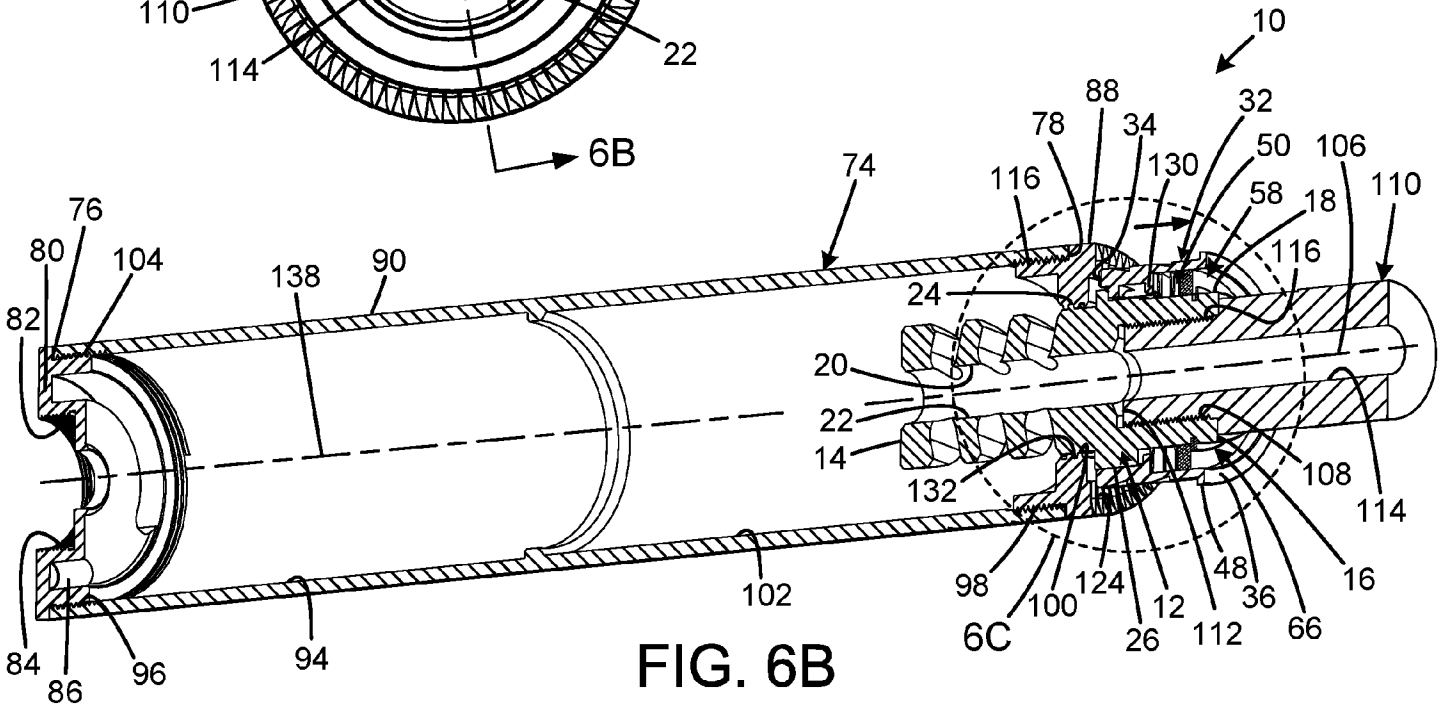
FIG. 6B is an isometric sectional view of the firearm suppressor mounting device taken along the line 6B-6B of FIG. 6A. in the unsecured condition.
Figure 6C:
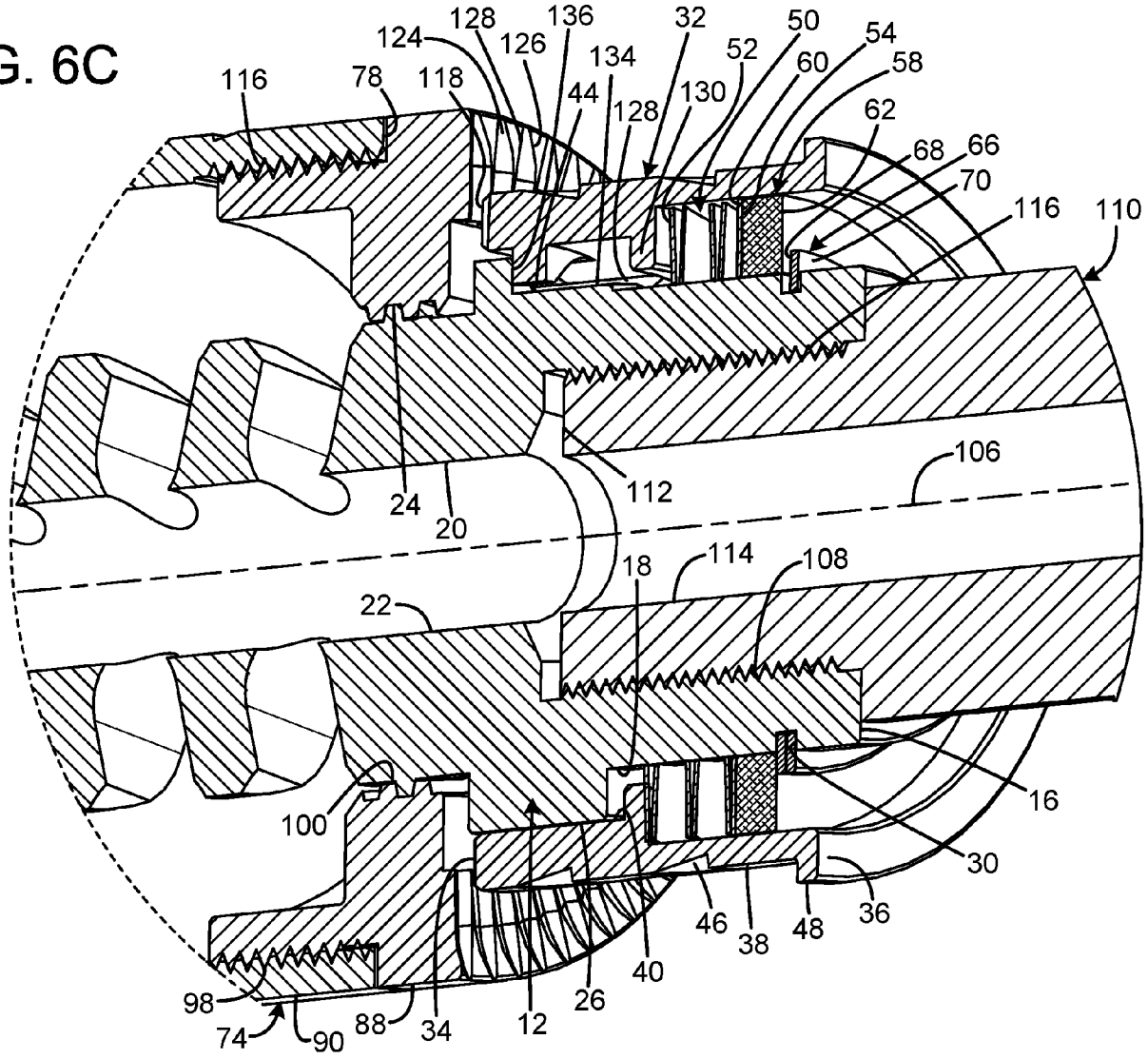
FIG. 6C is an enlarged view of the firearm suppressor mounting device taken along circle 6C of FIG. 6B in the unsecured condition.

The wave spring 50 has a front 52, rear 54, and a central bore 56. The dust washer 58 has a front 60, rear 62, and a central bore 64. The retaining ring 66 has a front 68, rear 70, and central bore 72. The wave spring 50 biases the slip ring 32 to the engaged position such that the teeth 118 of the slip ring 32 mesh with the mating teeth 124 (shown in FIGS. 3B, 4A, 4B, and 6C) on the rear cap 88 (FIG. 4B shows the teeth locked together.)

When the firearm suppressor mounting device 10 is assembled, the central bore 42 of the slip ring 32 receives the rear 16 of the muzzle brake 12. The front 52 of the wave spring 50 abuts the shoulder 130 of the slip ring and biases the shoulder of the slip ring against the flange 26 of the muzzle brake 12. The front 60 of the dust washer 58 abuts the rear 54 of the wave spring 50. The rear 62 of the dust washer 58 abuts the front 68 of the retaining ring 66. The central bore 56 of the wave spring 50 and the central bore 64 of the dust washer 58 closely receive the rear exterior 18 of the muzzle brake. The central bore 72 of the retaining ring 66 snaps into the groove 30 of the muzzle brake 12. The retaining ring 66 limits the rearward movement of the dust washer 58, wave spring 50, and slip ring 32. The flange 26 of the muzzle brake 12 limits the forward movement of the slip ring 32, wave spring 50, and dust washer 58. To install the retaining ring 66, the wave spring 50 is compressed slightly, providing a preload force to keep the slip ring 32 forced against the flange 26 of the muzzle brake 12 in a ready position to receive the suppressor 74. After assembly, the items 12, 32, 50, 58 and 66 remain attached to form one part of this invention.

The device/suppressor 74 has a front 76, rear 78, exterior 90, interior 94 (shown in FIG. 3B), and central bore 102 that defines a central axis 138. The rear of the exterior 90 defines grip features 92 on a textured outer wall surface that facilitate manual gripping for rotational movement of the suppressor by a user's hand. The front interior 94 of the suppressor 74 has a threaded portion 96, and the rear 78 interior 94 of the suppressor has a threaded portion 98. A front cap 80 screws into the front of the suppressor 74 by a threaded portion 104 that engages with threads 96. The front cap 80 has a central bore 82 that defines a threaded portion 84. The front cap 80 also has front wrench apertures 86 to facilitate the removal of the front cap from the suppressor 74. A rear cap 88 screws into the rear of the suppressor by a threaded portion 116 that engages with threads 98. The rear cap 88 has a central bore 132 that defines a threaded portion 100 and a rearward-facing saw tooth wave 124 defined on a rear panel. The saw tooth wave 124 is evenly spaced around the suppressor central axis 138 defined by the suppressor 74. Each of the saw teeth 124 in the saw tooth wave has a sloped cam surface 126 (shown in FIG. 4B) and an opposing flat surface 128. In the current embodiment, the saw tooth wave has 75 saw teeth. Thus, the slip ring's saw tooth wave 118 and the suppressor's saw tooth 124 wave have the same number of engagement features/saw teeth such that each of the engagement features of the suppressor 74 is engaged by a respective engagement feature of the slip ring 32 when the teeth are engaged. The saw teeth in both saw tooth waves mate at the same angle, creating a lock. In the current embodiment, the engagement features are distributed at regular angular intervals about the central bore axis 106 of the firearm 122.

When the suppressor 74 is to be secured to the muzzle 112 of the barrel 110, the user first screws the rear 16 of the muzzle brake assembly 12, 32, 50, 58, 66 onto the muzzle end of the barrel in a clockwise direction by engaging the threaded portion 108 of the muzzle brake 12 with the threaded portion 116 of the barrel 110. An appropriately sized wrench can be used to engage the opposing flats 140, 142 on the muzzle brake 12 to semi-permanently secure the muzzle brake assembly 12, 32, 50, 58 and 66 onto the firearm 122. The user then screws the rear 78 of the suppressor 74 onto the muzzle brake 12 in a clockwise direction by engaging the threaded portion 100 of the rear cap 88 with the threaded portion 24 of the muzzle brake. The threaded portions 24, 100 are coarse to enable rapid installation with the least amount of rotations required to fully engage the threaded portions with each another (approximately 2½ rotations in the current embodiment). As the rear cap 88 approaches front 34 of the slip ring 32, the saw tooth wave 124 on the rear cap 88 ratchets over the saw tooth wave 118 on the front of the slip ring 32 because the engagement of the splines 44 with the longitudinal slots 28 prevents rotation of the slip ring 32. The ratcheting is facilitated by the cam surfaces 126 on each of the saw teeth in the saw tooth waves 118, 124 moving up and over each adjacent tooth during rotation from the user, urged by a progressively increasing force from the wave spring 50. When the suppressor 74 reaches the end of travel, the wave spring is fully compressed, providing the maximum force to keep the teeth 118 on the slip ring 32 tightly meshed together/against the mating teeth 124 on the rear cap 88 of the suppressor 74, while maintaining optimum alignment of the suppressor 74 with central bore axis 138 coaxial with the central bore axis 106 of the firearm 122. Once the suppressor 74 is firmly screwed onto the threaded portion 24 of the muzzle brake 12, counterclockwise rotation of the suppressor is prevented by the engagement of the flat surfaces 128 on each of the saw teeth 118 and 124 under the heavy force provided by the wave spring 50. As a result, the suppressor 74 cannot loosen during normal operation of the firearm 122, even under heavy recoil and/or high frequency of recoils. The multi-toothed configuration on both saw tooth waves means the force to hold them apart as the sloped latched-shaped teeth cam over each other is lessened, making them subject to less wear, because each tooth is providing only a small fraction of the axial force generated by the wave spring, yet the spring force exerted by the wave spring can be appreciable to avoid inadvertent releasing under firearm recoil. The saw tooth waves/features are a plurality of engagement features that are engaged to-each other to prevent inadvertent rotation of the device 74 with respect to the body 12, 32, 50, 58, 66 when the retention facility/slip ring 32 is in the engaged position. The sloped cam surface/camming side 126 enables rotation in one direction when the retention facility/slip ring 32 is in the engaged position and a flat face 128 parallel to the central bore axis 106 prevents rotation in the opposite direction when the slip ring 32 is in the engaged position. To remove the suppressor 74, the user must axially depress the slip ring 32 to fully disengage the teeth 118 from the mating teeth 124 of the rear cap 88 of the suppressor 74 while rotating the suppressor 74 in a counter-clockwise direction (viewed from the suppressor end.)

FIGS. 5A-6C illustrate the improved firearm suppressor mounting device 10 of the present invention. More particularly, the mounting device is shown in the unsecured condition to enable the detachment of the suppressor 74 from the muzzle brake 12. The saw tooth wave 118 of the slip ring 32 has been temporarily disengaged from the saw tooth wave 124 of the rear cap 88 by the user pulling the slip ring rearward with sufficient force to compress the wave spring 50 and by disengaging the splines 44 from their longitudinal guide slots 28 by subsequently rotating the slip ring 32 10° counterclockwise (viewed from the rear end of the suppressor) to align the splines 44 with the recesses 134. The recesses 134 are less deep than the flange 26 of the muzzle brake is thick. As a result, when the user releases the slip ring 32, the forward walls 136 of the recesses 134 limit axial forward movement of the slip ring 32 and temporarily hold the saw tooth wave 118 spaced apart from the saw tooth wave 124. The user can then unscrew the suppressor 74 in a counterclockwise direction (viewed from the suppressor end) to disengage the threaded portion 100 of the rear cap from the threaded portion 24 of the muzzle brake 12 without having to worry about tooth engagement. The slip ring 32 can be easily returned to the secured position by rotating the slip ring 10° clockwise (viewed from the rear end of the suppressor) to engage the splines 44 with the longitudinal slots 28 and permitting the wave spring 50 to urge the slip ring 32 forward until the shoulder 130 abuts the flange 26 of the muzzle brake 12 so the assembly is ready to receive the suppressor 74. The body/muzzle brake 12 and the slip ring 32 are rotationally engaged to each other in a first orientation (when the splines 44 engage the longitudinal slots 28) when the retention facility is in the engaged position or when the slip ring is in a range of axial positions proximate the engaged position. The body 12 and retention facility/slip ring 32 are rotationally independent when the slip ring 32 is in the disengaged position with splines 44 out of their guide slots 28. The forward walls 136 in the flange 26 of the muzzle brake 12 serve as a step interface adapted to retain the retention facility/slip ring 32 in the disengaged position when the retention slip ring is rotationally displaced from the first orientation, making it easier for the user to unscrew the suppressor 74 from the firearm 122. During installation, the current invention still provides that when the suppressor 74 reaches the end of travel, the wave spring is fully compressed, providing the maximum force to keep the teeth 118 on the slip ring 32 tightly meshed together/against the mating teeth 124 on the rear cap 88 of the suppressor 74, while maintaining optimum alignment of the suppressor 74 with central bore axis 138 coaxial with the central bore axis 106 of the firearm 122.

In the context of the specification, the terms "rear" and "rearward" and "front" and "forward" have the following definitions: "rear" or "rearward" means in the direction away from the muzzle of the firearm, while "front" or "forward" means in the direction towards the muzzle of the firearm.

While a current embodiment of a firearm suppressor mounting device has been described in detail, it should be apparent that modifications and variations thereto are possible, all of which fall within the true spirit and scope of the invention.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. An attachment element for a firearm having a muzzle comprising:

a body defining a body bullet passage on a bore axis and having a first attachment facility at a first end;

the first attachment facility adapted to connect to the muzzle of the firearm;

the body having a second attachment facility;

a device adapted to removably and rotatably connect to the second attachment facility;

a retention facility connected to the body and movable between an engaged position in which the retention facility abuts the device and a disengaged position in which the retention facility is spaced apart from the device;

wherein the retention facility includes a ratchet mechanism that when in the engaged position permits rotation in one direction and prevents rotation in an opposite direction inhibiting removal of the device from the body; and each of the retention facility and the device having a plurality of engagement features that are engaged to each other to prevent rotation of the device with respect to the body when the retention facility is in the engaged position.

2. The attachment element of claim 1 including the retention facility encircling the bore axis.

3. The attachment element of claim 1 including the retention facility being movable axially in a direction parallel to the bore axis between the engaged position and the disengaged position.

4. The attachment element of claim 1 including the retention facility being biased to the engaged position.

5. The attachment element of claim 1 including the engagement features being saw tooth features having a sloped camming side enabling rotation in one direction when the retention facility is in the engaged position and a flat side parallel to the bore axis preventing rotation in the opposite direction when the retention facility is in the engaged position.

6. The attachment element of claim 1 including the body and the retention facility being rotationally engaged to each other in a first orientation when the retention facility is in the engaged position and when the retention facility is in a range of axial positions proximate the engaged position, and the body and retention facility being rotationally independent when the retention facility is in the disengaged position.

7. The attachment element of claim 6 wherein the body and retention facility have a step interface adapted to retain the retention facility in the disengaged position when the retention facility is rotationally displaced from the first orientation.

8. The attachment element of claim 1 wherein the retention facility is a cylindrical sleeve having a textured outer wall surface to facilitate manual gripping.

9. The attachment element of claim 1 wherein the engagement features of the device are defined in a rear panel of the device.

10. The attachment element of claim 1 wherein the engagement features of the device are arranged in a circle about a device axis defined by the device.

11. The attachment element of claim 1 wherein the device and the retention facility each have the same number of engagement features.

12. The attachment element of claim 1 wherein each of the engagement features of the device is engaged by a respective engagement feature of the retention facility when in the engaged position.

13. The attachment element of claim 1 wherein the engagement features are distributed at regular angular intervals about each of the device and the retention facility.

14. An attachment element for a firearm having a muzzle comprising:

a body defining a body bullet passage on a bore axis and having a first attachment facility at a first end;

the first attachment facility adapted to connect to the muzzle of the firearm;

the body having a second attachment facility;

a device adapted to removably and rotatably connect to the second attachment facility;

a retention facility connected to the body, encircling the bore axis, and movable between an engaged position in which the retention facility abuts the device and a disengaged position in which the retention facility is spaced apart from the device;

wherein the retention facility includes a ratchet mechanism that when in the engaged position permits rotation in one direction and prevents rotation in an opposite direction inhibiting removal of the device from the body;

the device having a plurality of engagement features and the retention facility having a mating surface feature that are engaged to each other to prevent rotation of the device with respect to the body when the retention facility is in the engaged position; and the retention facility having a surface contour.

15. The attachment element of claim 14 including the retention facility being movable axially in a direction parallel to the bore axis between the engaged position and the disengaged position.

16. The attachment element of claim 14 including the retention facility being biased to the engaged position.

17. The attachment element of claim 14 including the engagement features being saw tooth features having a sloped camming side enabling rotation in one direction when the retention facility is in the engaged position and a flat side parallel to the bore axis preventing rotation in the opposite direction when the retention facility is in the engaged position.

18. The attachment element of claim 14 including the body and the retention facility being rotationally engaged to each other in a first orientation when the retention facility is in the engaged position and when the retention facility is in a range of axial positions proximate the engaged position, and the body and retention facility being rotationally independent when the retention facility is in a disengaged position.

19. The attachment element of claim 18 wherein the body and retention facility have a step interface adapted to retain the retention facility in the disengaged position when the retention facility is rotationally displaced from the first orientation.

20. The attachment element of claim 14 wherein the retention facility is a cylindrical sleeve having a textured outer wall surface to facilitate manual gripping.

* * * * *